US009254492B2

(12) United States Patent
Gardner et al.

(10) Patent No.: US 9,254,492 B2
(45) Date of Patent: Feb. 9, 2016

(54) GRINDER WITH ADJUSTABLE SCREENS

(75) Inventors: John Gary Gardner, Altoona, IA (US); Darin Lyn Dux, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 239 days.

(21) Appl. No.: 13/991,057

(22) PCT Filed: Nov. 30, 2011

(86) PCT No.: PCT/US2011/062620

§ 371 (c)(1), (2), (4) Date: May 31, 2013

(87) PCT Pub. No.: WO2012/075127

PCT Pub. Date: Jun. 7, 2012

(65) Prior Publication Data

US 2013/0240652 A1 Sep. 19, 2013

Related U.S. Application Data

(60) Provisional application No. 61/458,998, filed on Dec. 1, 2010.

(51) Int. Cl.

| | |
|---|---|
| ***B02C 23/16*** | (2006.01) |
| ***B07B 1/18*** | (2006.01) |
| ***B02C 13/284*** | (2006.01) |

(52) U.S. Cl.

CPC ..... *B02C 23/16* (2013.01); *B02C 13/284* (2013.01); *B07B 1/185* (2013.01); *B02C 2023/165* (2013.01); *Y10T 29/49721* (2015.01)

(58) Field of Classification Search

CPC ..... B02C 23/08; B02C 23/10; B02C 19/11; B02C 23/284

USPC ..... 241/73

See application file for complete search history.

(56) References Cited

U.S. PATENT DOCUMENTS

| | | | | |
|---|---|---|---|---|
| 3,929,647 | A * | 12/1975 | Kempa | 209/395 |
| 4,008,857 | A | 2/1977 | Schutte | |
| 4,101,080 | A | 7/1978 | Schmidt | |
| 4,907,750 | A * | 3/1990 | Seifert | 241/73 |
| 5,713,525 | A | 2/1998 | Morey | |
| 5,881,959 | A | 3/1999 | Hadjinian et al. | |
| 6,260,778 | B1 | 7/2001 | Wenger | |
| 7,461,802 | B2 | 12/2008 | Smidt et al. | |
| 2007/0176034 | A1 | 8/2007 | Roozeboom | |

FOREIGN PATENT DOCUMENTS

DE 1975016 U 12/1967

OTHER PUBLICATIONS

International Search Report for corresponding International Patent Application No. PCT/US2011/062620 mailed Jun. 12, 2012.

Office action issued for German Patent Application No. 11 2011 103 994.8 including English translation, dated Oct. 22, 2014, 9 pages.

* cited by examiner

*Primary Examiner* — Mark Rosenbaum

(74) *Attorney, Agent, or Firm* — Merchant & Gould P.C.

(57) ABSTRACT

A grinder having an adjustable screen arrangement. The adjustable screen arrangement including two screens independently positionable in a number of positions relative to a grinding drum. Each screen further having a leading end independently positionable relative a trailing end of the screen. The adjustable screen arrangement allowing for selectively varied clearances between the screens and the grinding drum.

17 Claims, 11 Drawing Sheets

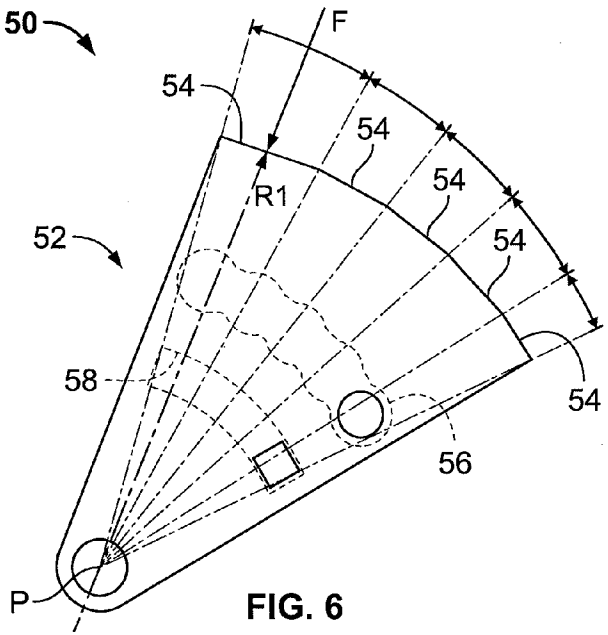
FIG. 6
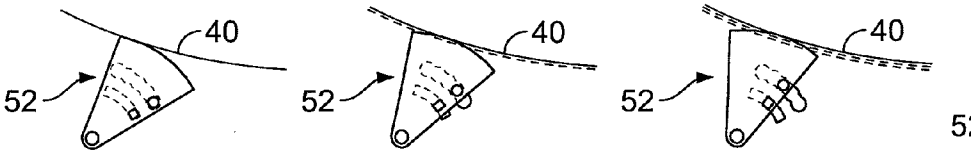
FIG. 7
FIG. 8
FIG. 9
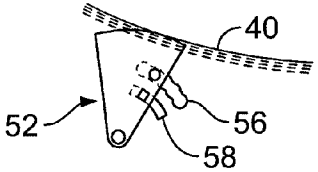
FIG. 10
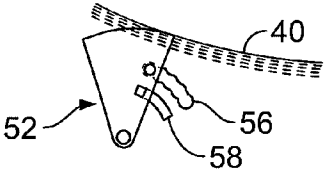
FIG. 11

GRINDER WITH ADJUSTABLE SCREENS

This application is a National Stage of PCT/US2011/062620, filed Nov. 30, 2011, which claims benefit of U.S. Provisional Patent Application Ser. No. 61/458,998, filed Dec. 1, 2010, and which applications are incorporated herein by reference. To the extent appropriate, a claim of priority is made to each of the above disclosed applications.

FIELD OF THE TECHNOLOGY

This disclosure generally relates to grinding machines. In particular, this disclosure relates to a screen arrangement for a horizontal grinding machine, and associated methods.

BACKGROUND

Machines, such as grinders and chippers, are used for shredding, grinding, and/or chipping a variety of material. For the purposes of this disclosure, the preferred environment in which the principles of the invention are described is that of a grinder. Horizontal grinders and tub grinders are illustrative of grinder machines, and the example of a horizontal grinder will be used herein as a preferred environment in which the present invention may be employed. References herein to a horizontal grinder, however, are not intended to be limiting. Instead, the principles of the invention are generally applicable to machines which utilize a screen in connection with reducing larger-piece material into smaller-piece material.

Horizontal grinders generally include a grinding chamber and a grinding drum. The grinding drum rotates and includes hammers or blocks. Screens position material so that the material is forced into contact with the grinding drum until ground/reduced to a certain size. Once the material reduces to the certain size, the material passes through holes in the screen and exits out of the grinding chamber.

The ability to grind of a variety of different material is desirable, as the usefulness of grinding or chipping different material arises in a variety of applications. For instance, waste is often ground to increased the rate of decomposition, which is useful in landfill operations; wood waste is ground to produce mulch that is useful in landscaping applications; and asphalt is ground to promote recycling efforts.

Accordingly, providing a machine that can grind a variety of material, and that is easily adaptable would be advantageous. In addition, providing a machine that better accommodates for wear situations would allow operators to more effectively operate such machines. Improvement has been sought with respect to such machines, generally to better accommodate ease of use, ease of adaptability, and ease of maintenance.

SUMMARY

One aspect of the invention relates to a horizontal grinder having an adjustable screen arrangement. The adjustable screen arrangement includes two screens that are independently positionable in any one of a number of positions relative to a grinding drum. Each screen further has a leading end that is independently positionable relative a trailing end of the screen. The adjustable screen arrangement allows an operator to selectively vary the clearances between the screens and the grinding drum. The adjustable screen arrangement also allows an operator to replace a portion of the screen area without having to replace the entire screened area, or switch the locations of a heavily worn first screen and a second screen so that grinding operation can continue.

A variety of examples of desirable product features or methods are set forth in part in the description that follows, and in part will be apparent from the description, or may be learned by practicing various aspects of the disclosure. The aspects of the disclosure may relate to individual features as well as combinations of features, including combinations of features disclosed in separate embodiments. It is to be understood that both the foregoing general description and the following detailed description are explanatory only, and are not restrictive of the claimed invention.

BRIEF DESCRIPTION OF THE DRAWINGS

FIG. 6 is a top plan view of an adjusting member of the screen arrangement of FIG. 1.

FIGS. 7-11 are schematic representations of the adjusting member of FIG. 6 illustrated in different operating positions.

DETAILED DESCRIPTION

Reference will now be made in detail to exemplary aspects of the present disclosure that are illustrated in the accompanying drawings. Wherever possible, the same reference numbers will be used throughout the drawings to refer to the same or like parts.

Figure 1:
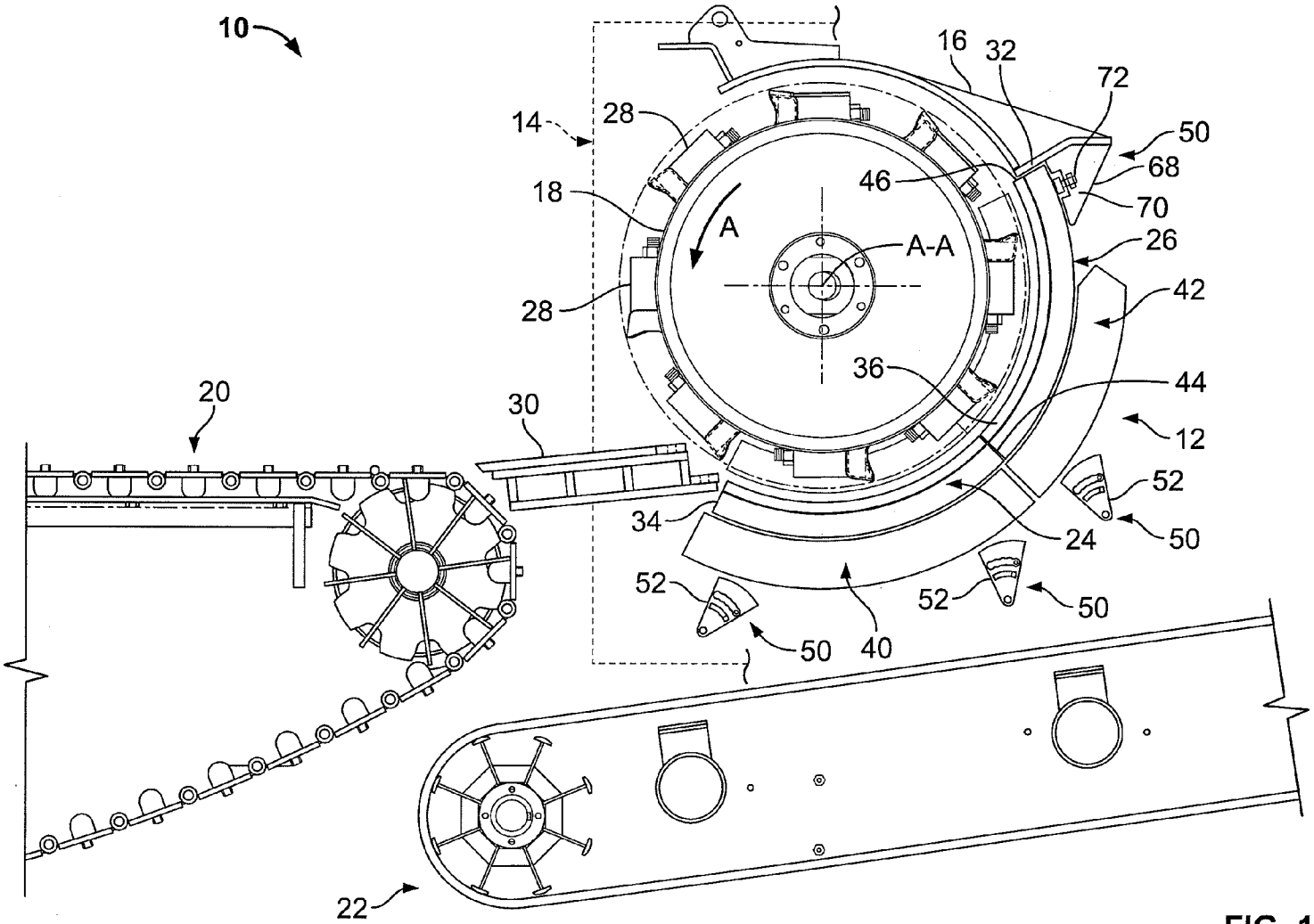
FIG. 1 is a partial side view of a horizontal grinder having an adjustable screen arrangement in accordance with the principles disclosed.
Figure 2:
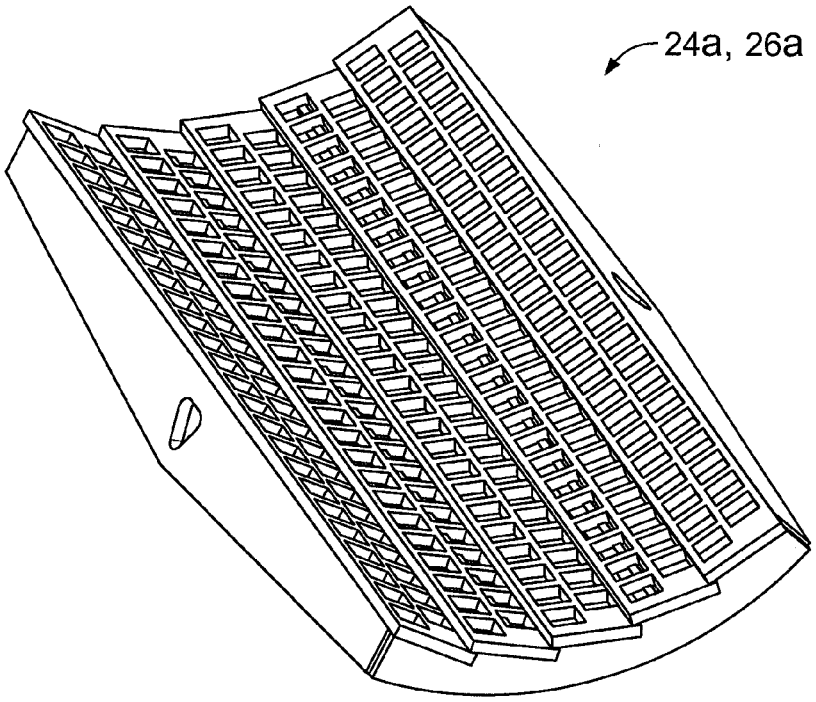
FIGS. 2-5 are perspective views of example screens that can be used in the screen arrangement of FIG. 1.
Figure 3:
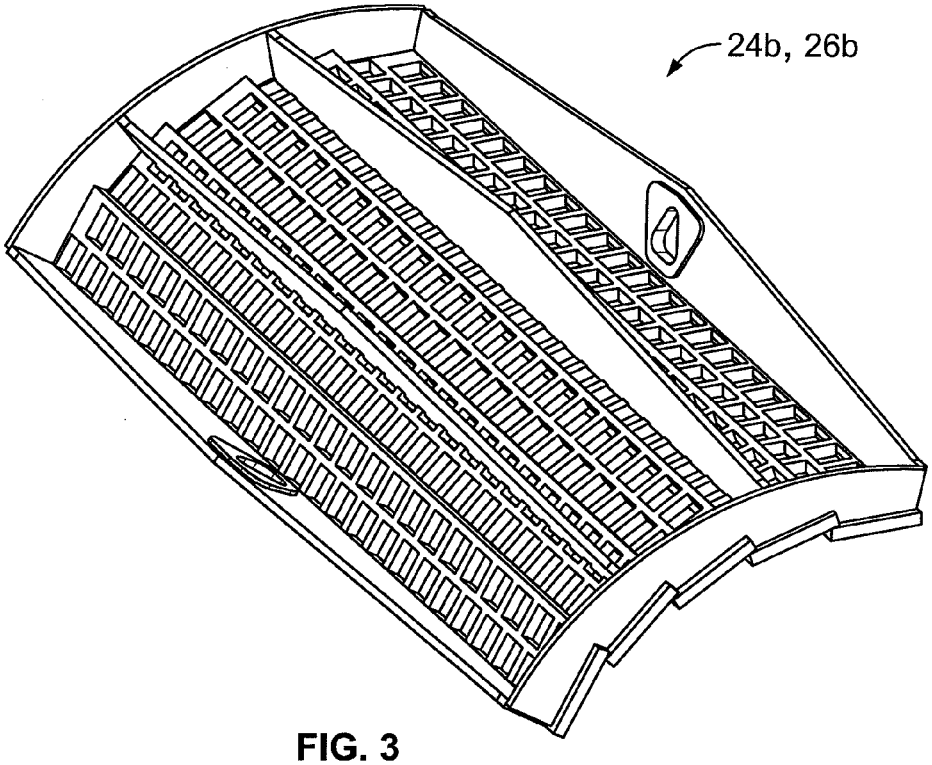
Figure 4:
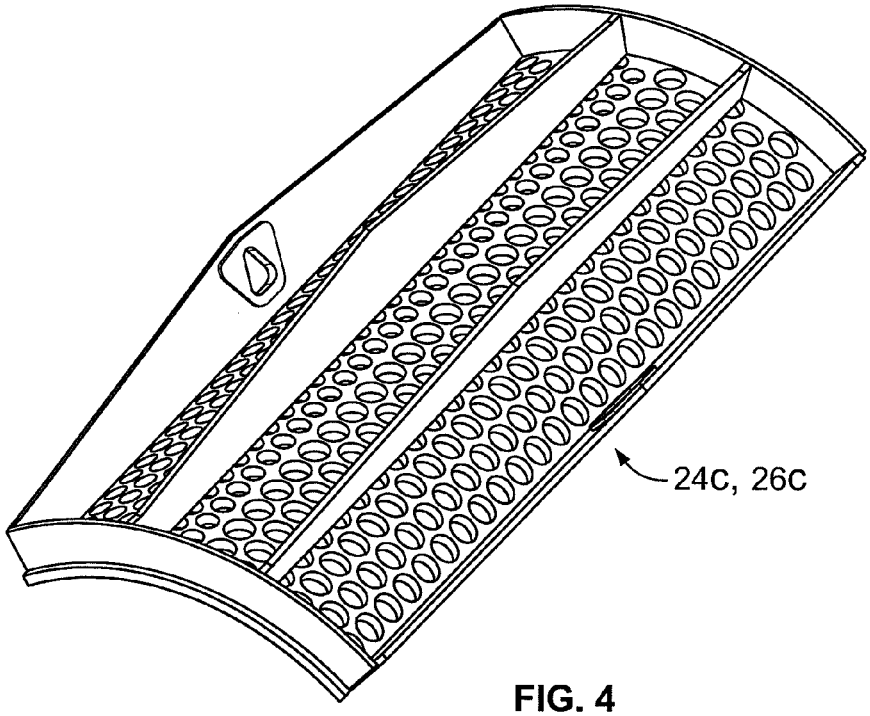
Figure 5:
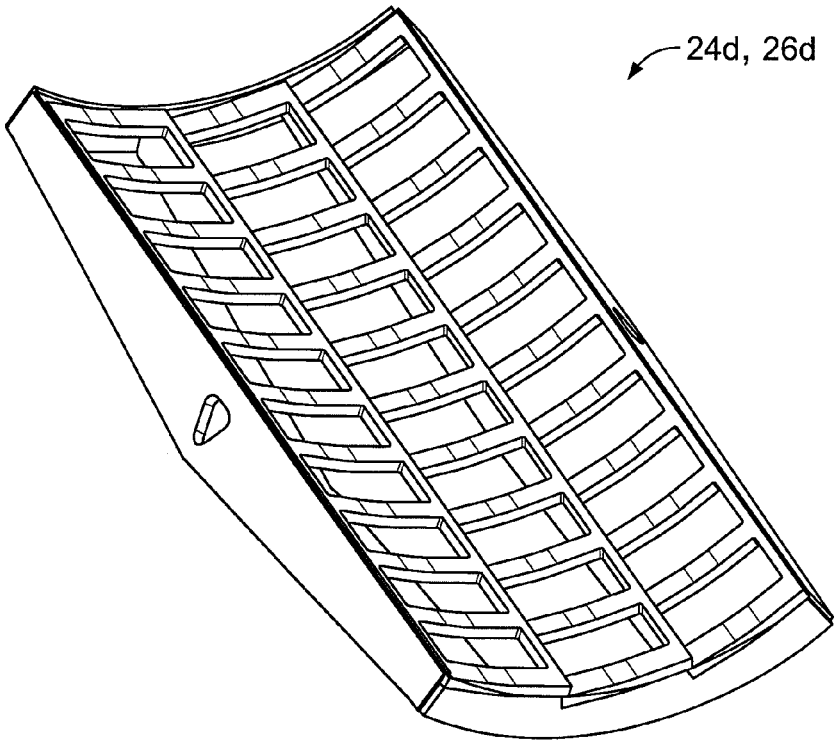

FIG. 1 is a representation of a horizontal grinder 10 having an adjustable screen arrangement 12 in accordance with the principles disclosed. In the illustrated embodiment, the horizontal grinder 10 includes a mill box 14 (partially and schematically represented in FIG. 1), a mill box cover 16, a grinding drum 18, and an anvil 30. A feed conveyor 20 is used to move material toward the mill box 14 to a point where a feed roller (not shown) forces material into contact with the grinding drum 18.

The grinding drum 18 grinds the material to a sufficiently small size so as to fall through the screen arrangement 12. In particular, the grinding drum includes hammers or cutters 28 mounted to the outer perimeter of the drum that impact the material as the material is fed into the mill box. In the illustrated embodiment, the grinding drum is a down-cut grinding drum. The grinding impact of the down-cut grinding drum is primarily experienced by the anvil 30. However, once the material passes by the anvil, the material is further reduced, as necessary within the mill box 14 until small enough to pass through the screen arrangement 12. A discharge conveyor 22 receives the ground material for transport to a desired location.

The adjustable screen arrangement 12 of the present disclosure positions the material so as to be further reduced by the grinding drum 18 as needed. The screen arrangement 12 generally includes two arcuate screens; e.g., a first arcuate screen 24 and a second arcuate screen 26. As will be understood, more than two arcuate screens can be provided in accordance with the principles disclosed. Representative examples of screens that can be used are shown in FIGS. 2-5. The screens 24(*a-d*), 26(*a-d*) illustrated in FIGS. 2-5 have different hole configurations. The screens can be of a variety of sizes and configurations, selected by the operator to achieve a desired size and quality of ground material.

Referring back to FIG. 1, the two arcuate screens 24, 26 are located adjacent to the grinding drum 18. The grinding drum 18 rotates about a rotational axis A-A in the direction shown (see arrow A). The direction of rotation of the drum 18 has the effect of urging material between the screens 24, 26 and the grinding drum 18. The forces exerted on the material by the grinding drum 18 and/or cutters 28 of the drum grind the material until small enough to drop through the screens 24, 26 and onto the discharge conveyor 22.

The arcuate screens 24, 26 each have a leading edge 34, 36 and a trailing edge 44, 46. The trailing edge 44 of the first screen 24 abuts the leading edge 36 of the second screen 26. The leading edge 34 of the first screen 24 abuts the anvil 30; the anvil 30 prevents the two screens 24, 26 from moving forward or moving in a clockwise direction. The trailing edge 46 of the second screen 26 abuts a shoulder 32 provided on the mill box cover 16; the shoulder 32 prevents the two screens 24, 26 from moving rearward or moving in a counter-clockwise direction.

Referring still to FIG. 1, the adjustable screen arrangement 12 of the present disclosure also includes screen supports or support members 40, 42, and a plurality of adjusting members or adjusting devices 50.

The plurality of adjusting members 50 positions each arcuate screen 24, 26 in the selected one of a plurality of positions relative to the grinding drum 18. In particular, the adjusting members 50 position the screen supports 40, 42 so as to support the arcuate screens 24, 26 in a selected position relative to the grinding drum 18. This feature permits an operator to easily adapt the horizontal grinder 10 to accommodate different types of material, or accommodate material of different sizes. That is, changing the positions of one or both screens changes the clearance between the one or both screens and the grinding drum. This allows the operator to accommodate a change in material, or to adjust the grinding characteristics of the machine if needed.

Further, the screens 24, 26 are positionable relative to the grinding drum 18 independent of one another. That is, the first screen support 40 can be positioned to provide a larger clearance between the first screen 24 and the drum 18, while the second screen support 42 can be positioned to have a smaller clearance between the second screen 26 and the drum 18. This can be useful in applications where the machine's grinding characteristics require more customization. Along this same line, the adjusting members are also arranged to selectively vary the clearance between the leading edge 34, 36 of each screen 24, 26 and the grinding drum 18, and selectively vary the clearance between the trailing edge 44, 46 of each screen and the grinding drum 18. That is, the leading edge clearance of a particular screen can be adjusted relative to the trailing edge clearance of that screen.

Referring now to FIGS. 1 and 6, the plurality of adjusting members 50 includes an adjusting cam member or cam 52. The cam 52 pivots to adjust the position of the screen supports 40, 42 and accordingly the screens 24, 26 relative to the grinding drum 18. Each cam 52 defines a series or plurality of arc sections 54 at one end, and a pivot point P at an opposite end. In the illustrated embodiment, the cam 52 has five arc sections 54.

Referring to FIG. 7, when the cam is in a first position, the screen support (e.g., 40, schematically represented), and accordingly the screen (e.g., 24, FIG. 1) are in a first position relative to the grinding drum. Referring to FIGS. 8-11, as the cam 52 is pivoted to second through fifth positions, the screen support (e.g., 40) and screen move to second through fifth positions relative to the grinding drum (see dashed lines in FIGS. 8-11 representing the previous position(s) of the screen support 40).

Fasteners secure the cam 52 in the selected position. The fasteners are received within apertures 56, 58 (FIG. 12) formed in sides 60 (FIG. 13) of the mill box 14. In the illustrated embodiment, a first fastener 62 is received within the aperture 56 having circular portions, and a second fastener 64 is received within the aperture 58 having an arcuate slot shape. The circular portions of aperture 56 can be used as reference to indicate to the operator the particular positioning of the adjusting cam member 52. Other reference notation or indicia can be used.

Figure 12:
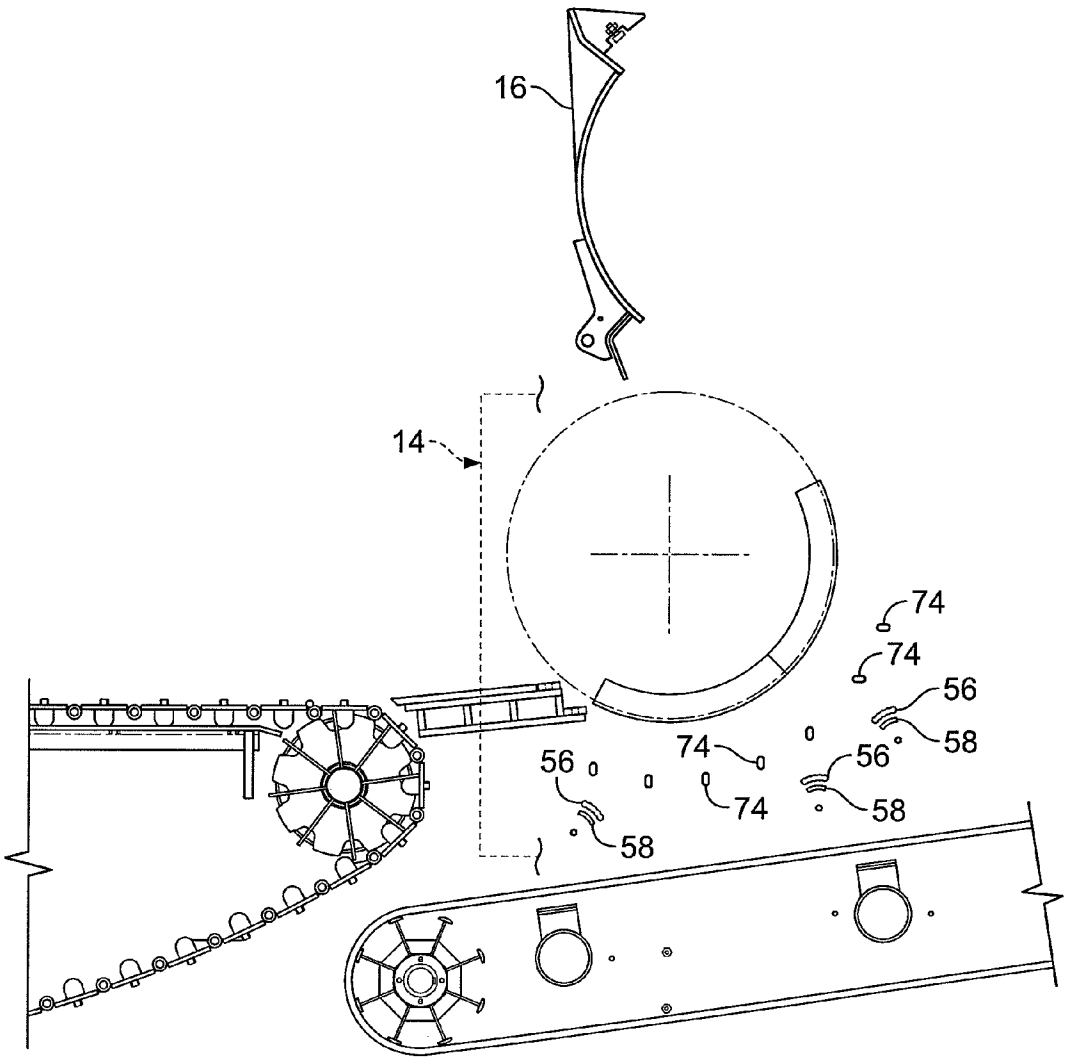
FIG. 12 is a partial side view of the horizontal grinder of FIG. 1, illustrating a mounting hole pattern formed in a side of a mill box of the grinder.

Referring to FIG. 12, slotted apertures 74 are also formed in the sides 60 of the mill box 14. The slotted apertures 74 are used for securing the screen support 40, 42 to the mill box. As can be understood, the slotted configuration of the apertures 74 allows for the movement of the screen supports to the desired positions.

Figure 14:
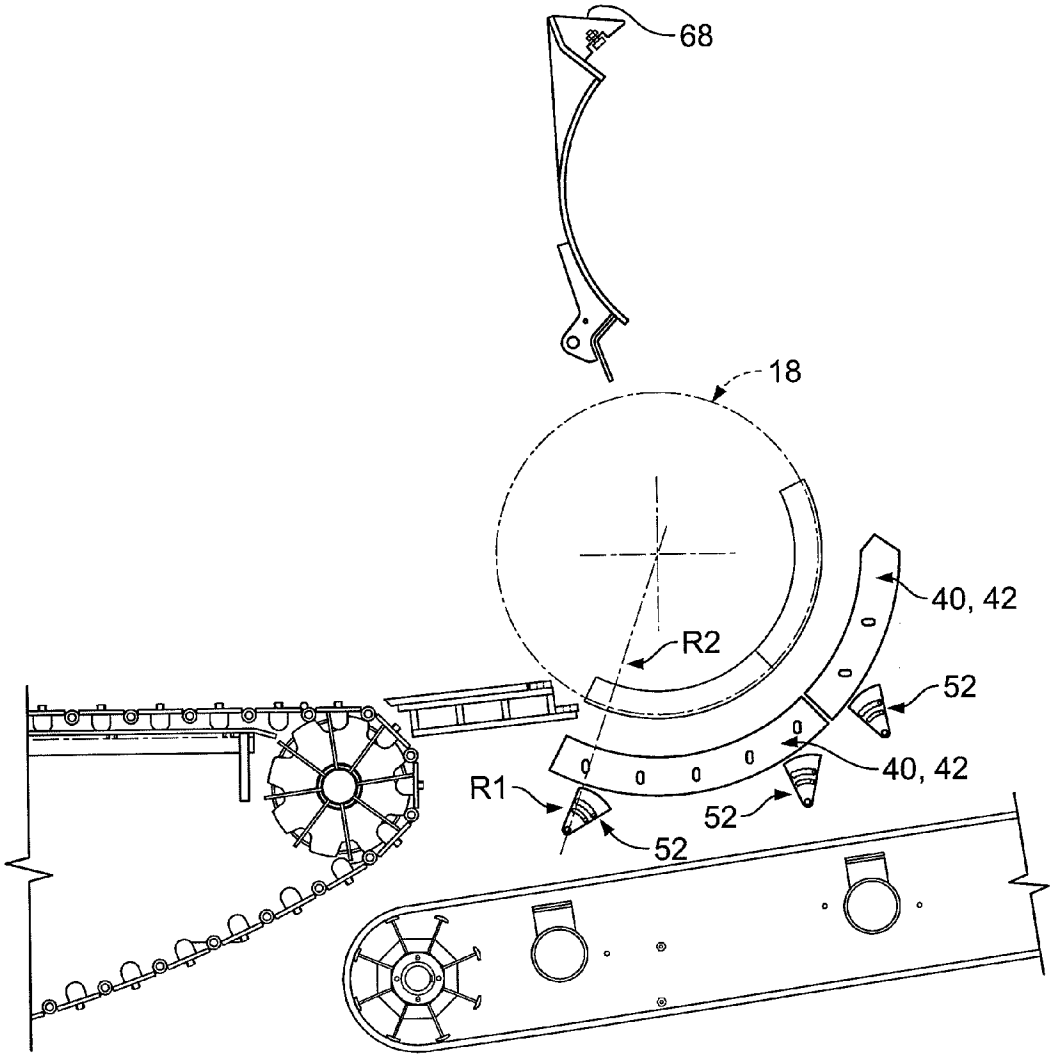
FIG. 14 is a partial side view of the horizontal grinder of FIG. 1, illustrating the arrangement of the adjusting members of the screen arrangement.
Figure 15:
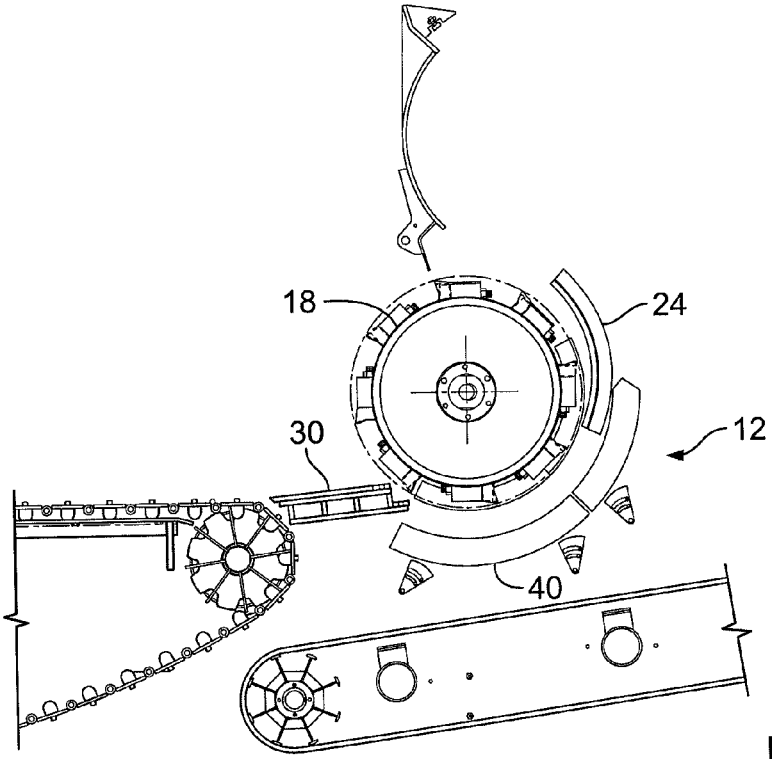
FIGS. 15-18 are partial side views of the horizontal grinder of FIG. 1, illustrating how the screens of the screen arrangement are installed.
Figure 16:
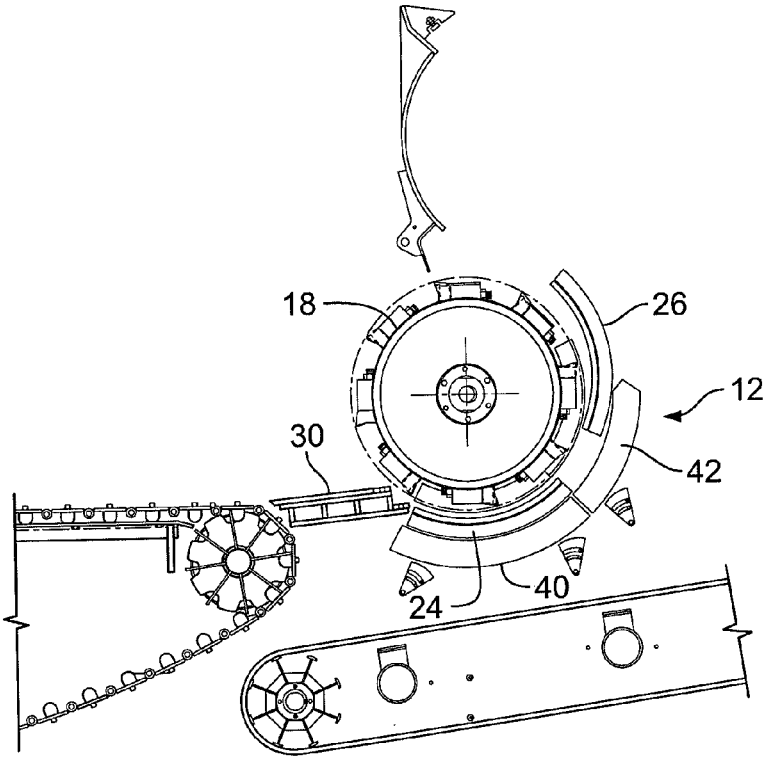
Figure 17:
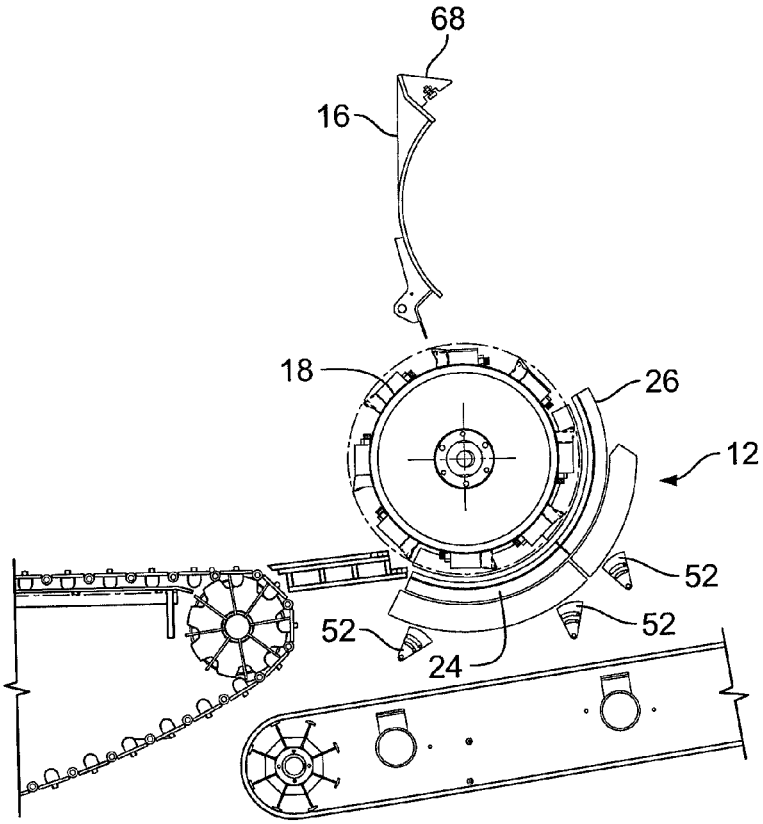
Figure 18:
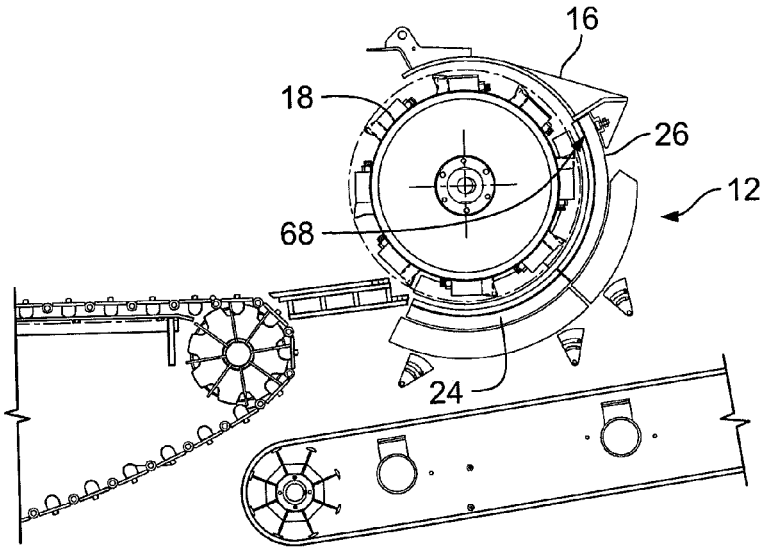

Referring now to FIGS. 6 and 14, the cams 52 experience load and operational forces F from contact with the screen supports 40, 42. The load and operational forces F are transferred from the contacting arc section 54 of the cam 52 to the center of the pivot point P (see FIG. 6). Transfer of the forces through the center of the pivot point P is provided by the arrangement and design of the cam wherein a central radius R1 of each contacting arc section 54 (dashed in FIGS. 6 and 14) is coaxial with a central radius R2 of the grinding drum 18 (see FIG. 14). This coaxial arrangement and design exists for each arc section 54 of each cam 52 when in contact with the corresponding screen support. Because the force F is directed through the center of the pivot point P (as opposed to being offset from the pivot point), torque about the pivot point P of the cam 52 is minimized or eliminated. This arrangement and design reduces or prevents occurrences where an offset force or torque inadvertently causes an element to pivot or loosen.

In addition to the adjusting cam members 52, the plurality of adjusting members 50 also includes an adjusting set-screw member 68. Referring again to FIG. 1, the adjusting set-screw member 68 is carried by the mill box cover 16. The adjusting set-screw member 68 includes a wedge or block 70 and a set screw 72. The set-screw member 68 allows an operator to vary the clearance between the trailing edge 46 of the second screen 26 and the grinding drum 18.

Figure 13:
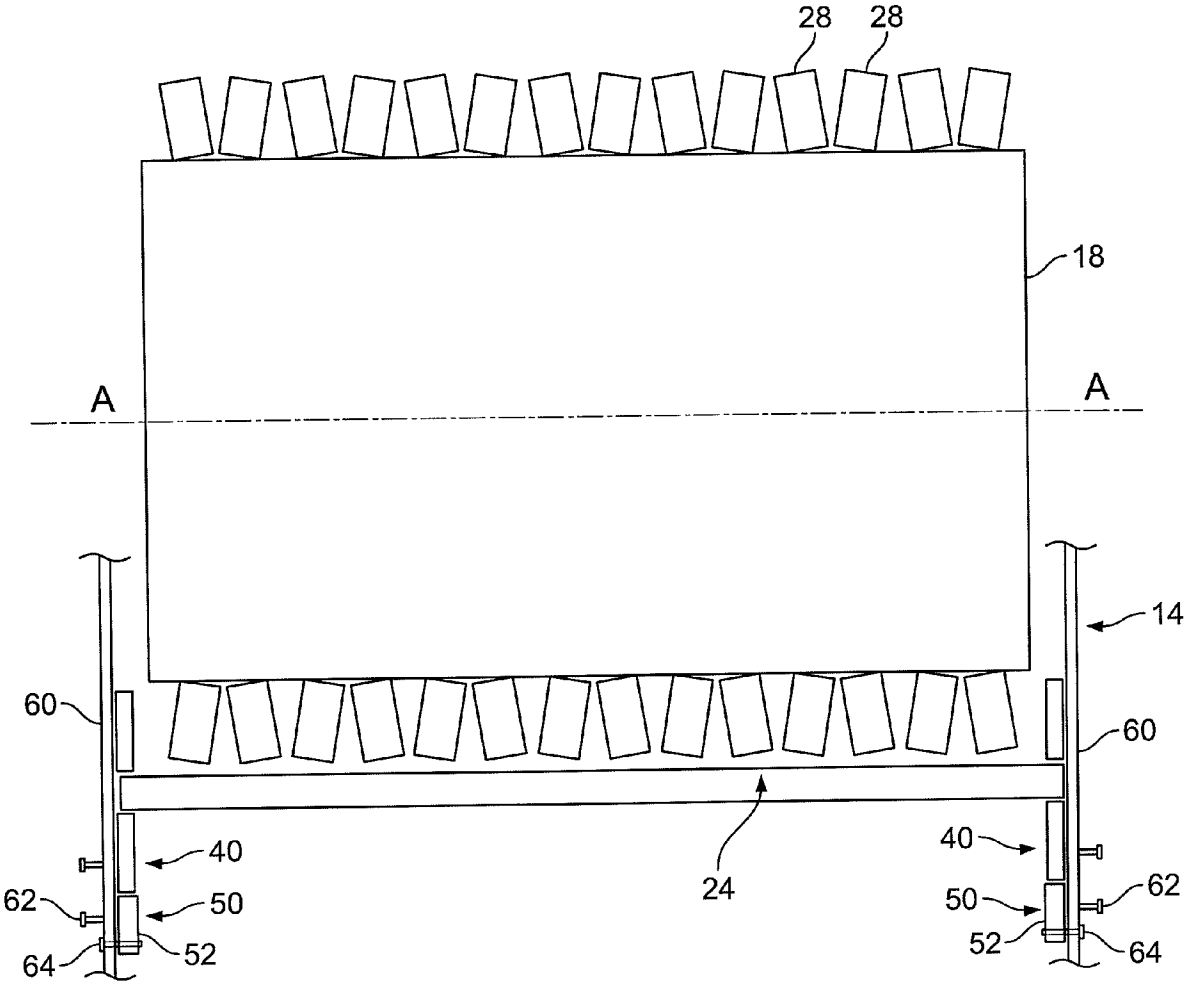
FIG. 13 is a partial front elevation view of the horizontal grinder of FIG. 1, illustrating a portion of the screen arrangement and mill box.

As can be understood with reference to FIGS. 1 and 13, each of the first screen 24 and the second screen 26 is positioned relative to the grinding drum by two pairs of adjusting members 50; i.e., a leading pair at both sides and adjacent to the leading edge 34, 36 of each screen 24, 26, and a trailing pair at both sides and adjacent to the trailing edge 44, 46 of each screen 24, 26. The two pairs of adjusting members that position the first screen 24 relative to the grinding drum are the adjusting cam members 52 that mounted to the sides 60 of the mill box 14. The two pairs of adjusting members that position the second screen 26 relative to the grinding drum include a pair of adjusting cam members 52 that mounted to the sides 60 of the mill box 14, and a pair of adjusting set-screw members 68 that are carried by the mill box cover 16.

FIGS. 15-18 illustrate one method of installing the screens 24, 26 of the disclosed screen arrangement 12. In the one method, the first screen 24 is inserted within the mill box in a counter-clockwise direction so as to be positioned adjacent to the anvil 30 and positioned upon a corresponding first one of the screen supports 40. The second screen 26 is then inserted within the mill box in a counter-clockwise direction so as to abut the first screen 24 and be positioned upon a corresponding second one of the screen supports 42. The adjusting cam members 52 are adjusted so that the leading and trailing edges of the first screen 24, and the leading edge of the second screen 26 are positioned as needed relative to the grinding drum 18. The mill box cover 16 is closed and the adjusting set-screw member 68 is adjusted so that the trailing edge of the second screen 26 is positioned as needed relative to the grinding drum 18.

As previously described, the present screen arrangement permits an operator to vary the clearance between the two screens and the grinding drum to accommodate different types of material or to accommodate material of a different size. In addition, the present screen arrangement 12 provides for ease of maintenance. With reference still to FIGS. 15-18, the method of replacing one or more screens is just as quick and easy as installing the screens. To replace one or both screens, an operator need only open the mill box cover 16 and slide the screens in and out of place. Providing a two-screen arrangement further permits replacement of only one screen, in contrast to having to replace an entire screened area. For example, a screen having the heavier wear (typically the first screen which receives greater impact forces) can be replaced without having to replace the second screen, which saves on parts & material costs. In the alternative, when one screen experiences heavier wear, the positions of the two screens about the circumference of the drum can be switched so that grinding operation can continue with the lesser worn screen now receiving the greater impact forces.

Figure 19:
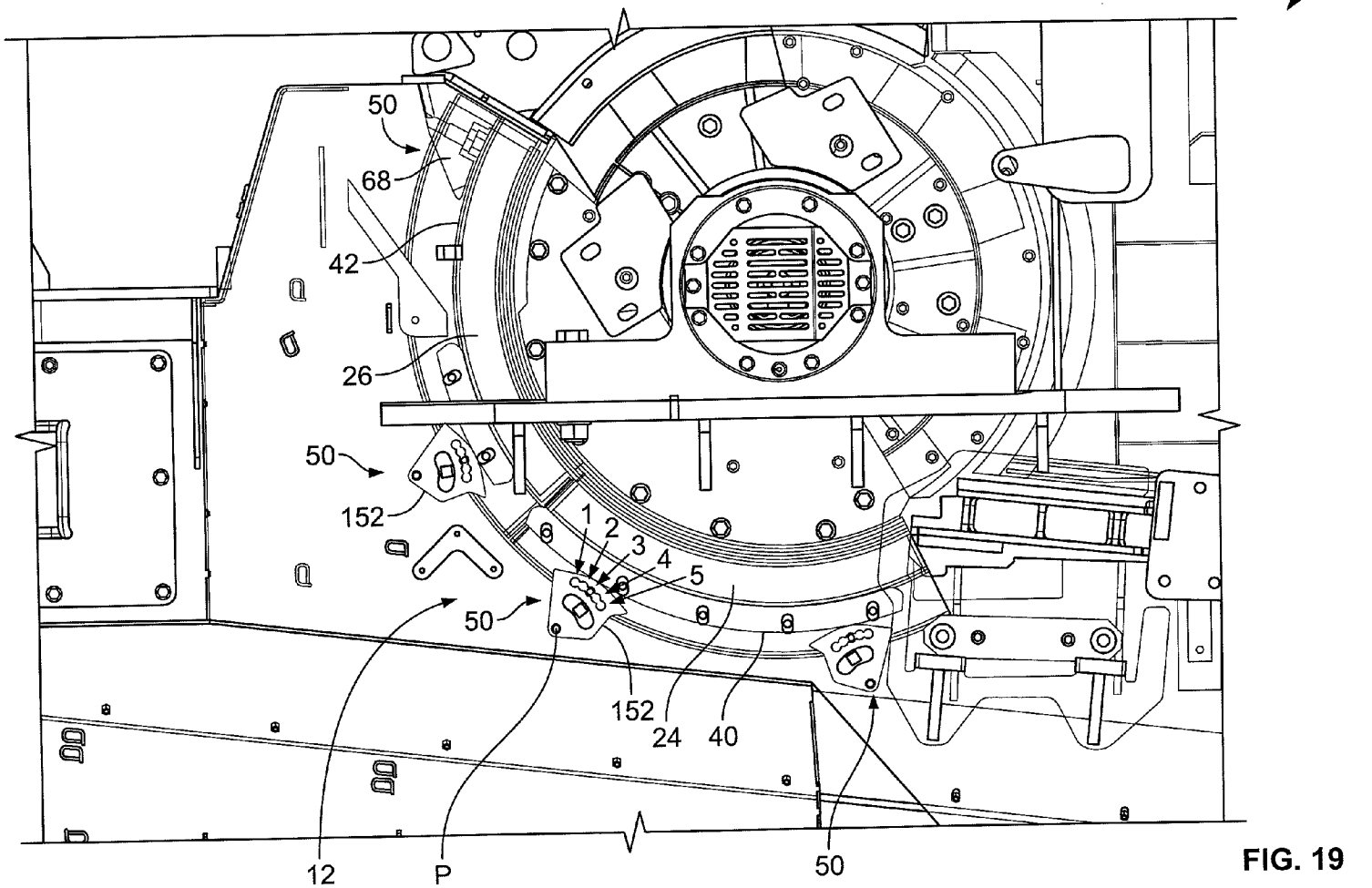
FIG. 19 is a partial side view of the horizontal grinder of FIG. 1, illustrating a second embodiment of an adjusting member that can be used in the screen arrangement in accordance with the principles disclosed.
Figure 20:
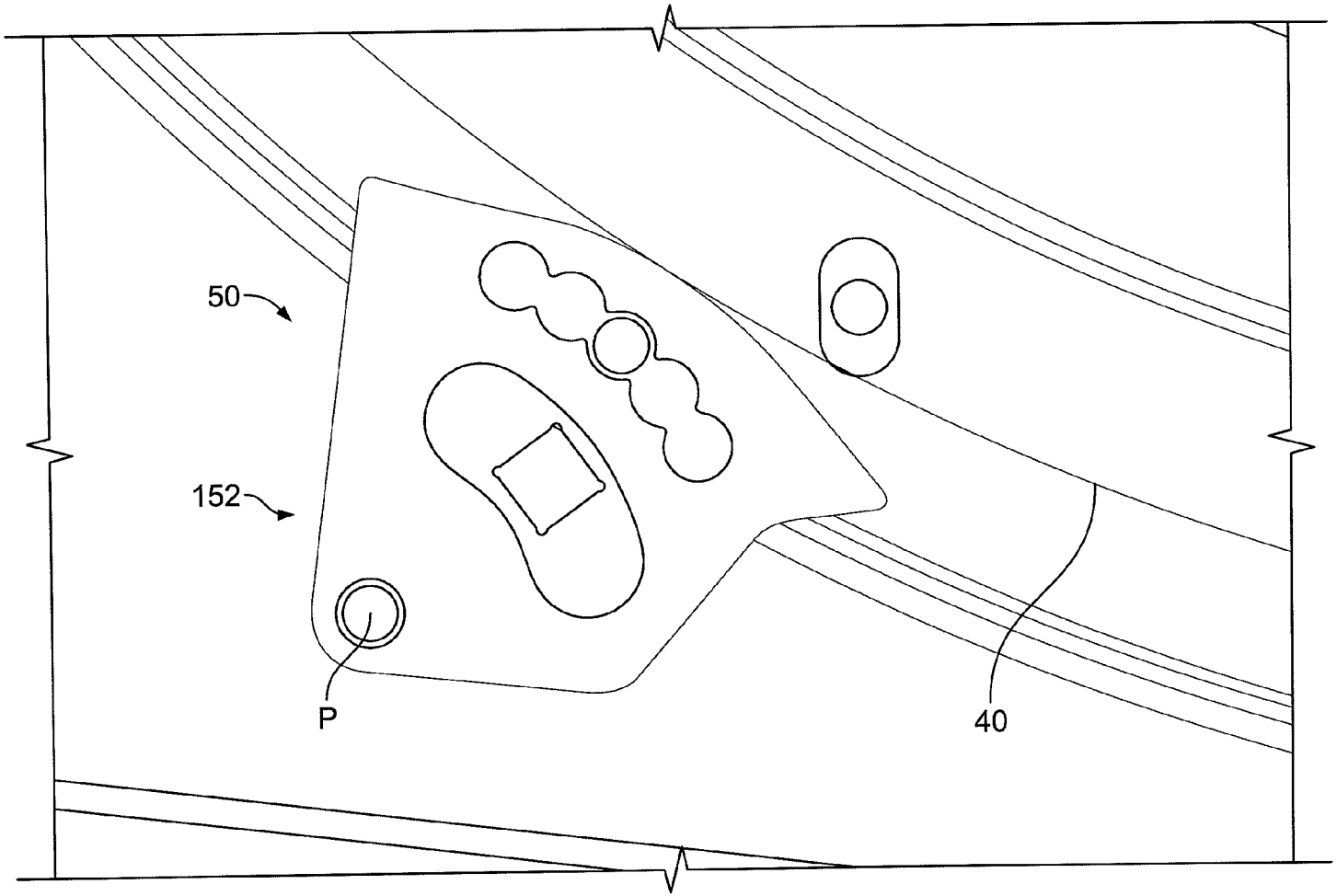
FIG. 20 is an enlarged side view of the second embodiment of the adjusting member of FIG. 19.

Referring now to FIGS. 19 and 20, a second embodiment of an adjusting cam member 152 is illustrated. The adjusting cam member 152 can be used in the screen arrangement 12 in accordance with the principles previously disclosed. In this second embodiment and similar to the first cam embodiment, each cam 152 defines a series or plurality of arc sections at one end (see the five arc sections identified by arrows 1-5 in FIG. 19), and a pivot point P at an opposite end. As previously described, load and operational forces are transferred from the contacting arc section of the cam 152 to the center of the pivot point P wherein torque about the pivot point P of the cam 152 is minimized or eliminated. The other features set forth in the above description concerning the first embodiment of adjusting cam members, the screen arrangement, and the horizontal grinder apply to this second embodiment of adjusting cam members.

The above specification provides a complete description of the present invention. Since many embodiments of the invention can be made without departing from the spirit and scope of the invention, certain aspects of the invention reside in the claims hereinafter appended.

What is claimed is:

1. A horizontal grinder, comprising:

a) a grinding drum;

b) at least two arcuate screens located adjacent to the grinding drum, the at least two arcuate screens having a leading edge and a trailing edge;

c) at least two screen supports, the at least two arcuate screens being positioned upon the at least two screen supports and being configured to slide into and out of place with respect to the at least two screen supports; and d) a plurality of adjusting members that position each screen in a selected one of a plurality of positions relative to the grinding drum, the plurality of adjusting members being adapted to move the at least two screen supports to adjust the position of the at least two arcuate screens;

e) wherein the screens are positionable relative to the grinding drum independent of one another; and f) wherein the adjusting members selectively vary the clearance between the leading edge of each screen and the grinding drum, and selectively vary the clearance between the trailing edge of each screen and the grinding drum, the leading edge clearance and the trailing edge clearance being adjustable independent of one another.

2. The grinder of claim 1, wherein the adjusting members include cams that pivot to adjust the position of the screens in the selected one of the plurality of positions.

3. The grinder of claim 2, wherein each cam defines a plurality of arc sections opposite a pivot point.

4. The grinder of claim 3, wherein load and operational forces from the screen supports transfer from one of the arc sections of each cam to the center of the pivot point of each cam.

5. The grinder of claim 1, wherein each of a first screen and a second screen of the plurality of arcuate screens is positioned relative to the grinding drum by two pairs of adjusting members.

6. The grinder of claim 5, wherein the two pairs of adjusting members that position the first screen relative to the grinding drum are mounted to sides of a mill box, and wherein one of the pairs of adjusting members that positions the second screen relative to the grinding drum is carried by a mill box cover.

7. The grinder of claim 6, wherein the one pair of adjusting members carried by the mill box cover varies the trailing edge clearance of the second screen.

8. The grinder of claim 7, wherein another one pair of the adjusting members that positions the second screen relative to the grinding drum is mounted to the side of the mill box, the another one pair of the adjusting members varying the leading edge clearance of the second screen.

9. A screen arrangement for a horizontal grinder having a mill box, a mill box cover, and a grinding drum, the screen arrangement comprising:

a) at least two arcuate screens, the at least two arcuate screens having a leading edge and a trailing edge;

b) at least two screen supports, the at least two arcuate screens being positioned upon the at least two screen supports and being configured to slide into and out of place with respect to the at least two screen supports; and c) a plurality of adjusting members that independently position each screen in a selected one of a plurality of positions, wherein the plurality of adjusting members are adapted to move the at least two screen supports to adjust the position of the at least two arcuate screens, at least one of the adjusting members defining a pivot point and a series of arc sections opposite the pivot point;

d) wherein the adjusting members selectively adjust the position of the leading edge of each screen, and selectively adjust the position of the trailing edge of each screen, the leading edge and the trailing edge being positionable independent of one another.

10. The arrangement of claim 9, wherein the adjusting members are arranged in pairs, each of the screens being positioned in the selected one of the plurality of positions by two pairs of the adjusting members.

11. The arrangement of claim 10, wherein the two pairs of adjusting members that position a first one of the screens are adjusting cam members that define the pivot point and the series of arc sections opposite the pivot point, and wherein one of the pairs of adjusting members that positions a second one of the screens is an adjusting set-screw member.

12. The arrangement of claim 11, wherein the adjusting set-screw member adjusts that position of the trailing edge of the second one of the screens.

13. A method of maintaining a horizontal grinder, comprising the steps of:

a) providing a horizontal grinder having a mill box, a mill box cover, a grinding drum, and a screen arrangement, the screen arrangement including a first screen and a second screen respectively located in first and second screen positions about the circumference of the grinding drum; and b) switching the positions of the first and second screens such that the heavier worn screen previously located in one of the first and second screen positions is positioned in the other of the first and second screen positions;

c) wherein the position of the leading edge and the position of the trailing edge of each screen is positionable in the respective screen position independent of one another.

14. The method of claim 13, wherein the step of switching the positions of the first and second screens includes removing the second screen from the second screen position, removing the first screen from the first screen position, installing the second screen in the first screen position, and installing the first screen in the second screen position.

15. The grinder of claim 1, wherein the at least two screen supports are positioned between the at least two arcuate screens and the plurality of adjusting members.

16. The arrangement of claim 9, wherein the at least two screen supports are positioned between the at least two arcuate screens and the plurality of adjusting members.

17. The grinder of claim 1, wherein at least one of the screen supports has a curvature that matches a curvature of at least one of the arcuate screens.

* * * * *